United States Patent [19]

Pilkington

[11] 4,183,408

[45] Jan. 15, 1980

[54] GAS PRODUCTION FROM SOURCE ROCK

[75] Inventor: Paul E. Pilkington, Houston, Tex.

[73] Assignee: Conoco, Inc., Ponca City, Okla.

[21] Appl. No.: 957,640

[22] Filed: Nov. 3, 1978

[51] Int. Cl.[2] ..... E21B 43/00

[52] U.S. Cl. ..... 166/314

[58] Field of Search ..... 166/314, 265

[56] References Cited

U.S. PATENT DOCUMENTS

| | | | |
|---|---|---|---|
| 1,083,018 | 12/1913 | Johnson | 166/314 |
| 1,787,972 | 1/1931 | Doherty | 166/314 X |
| 2,353,652 | 7/1944 | Coonrod | 166/314 X |
| 3,258,069 | 6/1966 | Hottman | 166/265 X |
| 3,451,477 | 6/1969 | Kelley | 166/314 X |
| 4,040,487 | 8/1977 | Cook, Jr. et al. | 166/314 |
| 4,042,034 | 8/1977 | Cook, Jr. et al. | 166/314 |
| 4,116,276 | 9/1978 | Cook, Jr. et al. | 166/314 |

OTHER PUBLICATIONS

Hodgson, "Natural Gas:The Search Goes On", *National Geographic*, vol. 154, No. 5, Nov. 1978.

*Primary Examiner*—Stephen J. Novosad
*Assistant Examiner*—George A. Suchfield
*Attorney, Agent, or Firm*—A. Joe Reinert

[57] ABSTRACT

Hydrocarbons are produced from source rocks in fluid communication with geopressured sections by (a) producing fluids from the geopressured section to reduce pressure, (b) shutting in to allow migration from the source rock to the formerly geopressured section, and (c) producing the migrated hydrocarbons from the section.

4 Claims, 1 Drawing Figure

GAS PRODUCTION FROM SOURCE ROCK

BACKGROUND OF THE INVENTION

1. Field of the Invention

The invention relates to the recovery of hydrocarbons from subterranean formations. In one aspect, the invention relates to the recovery of hydrocarbons from source rock in fluid communication with geopressured subterranean formation sections.

2. Brief Description of the Prior Art

U.S. Pat. No. 4,040,487 discloses a method for producing gas from a geopressured reservoir by producing a well at a high rate for a period whereupon gas separates from the geopressured water to form a gas cap from which gas is then produced. This process is applicable to geopressured sections containing gas dissolved in an aqueous liquid at high pressures, but differs from the instant invention in that the gas produced is exsolved from the aqueous liquid of the geopressured section.

U.S. Pat. No. 3,807,501 discloses producing oil and gas by drilling into a salt dome and washing out a cavity until the boundary between the salt and a hydrocarbon-containing formation is reached. Hydrocarbons then flow into the cavity, facilitating production thereof.

U.S. Pat. No. 2,792, 894 discloses a process particularly applicable to the Sprayberry Trend in west Texas wherein water is allowed to imbibe into less permeable sections of source rock, thereby displacing hydrocarbons into more permeable zones from which the oil is recovered.

OBJECTS OF THE INVENTION

An object of the invention is to provide a process for the recovery of hydrocarbons from source rocks lying in fluid communication with subterranean geopressured sections.

SUMMARY OF THE INVENTION

Hydrocarbons such as methane, condensate, and oil are produced from source rocks adjacent to geopressured sections by the following steps. Fluids are produced from the geopressured section to reduce pressure. The well employed to produce the fluids is then shut in to allow migration from the source rock to the formerly geopressured section in which the pressure has been reduced by production. The hydrocarbons which have migrated from the source rock to the section are then produced.

BRIEF DESCRIPTION OF THE DRAWING

The drawing illustrates a cross-section of a borehole penetrating a geopressured section both overlain and underlain by hydrocarbon-containing source rocks.

DESCRIPTION OF THE DRAWING

Figure 1:
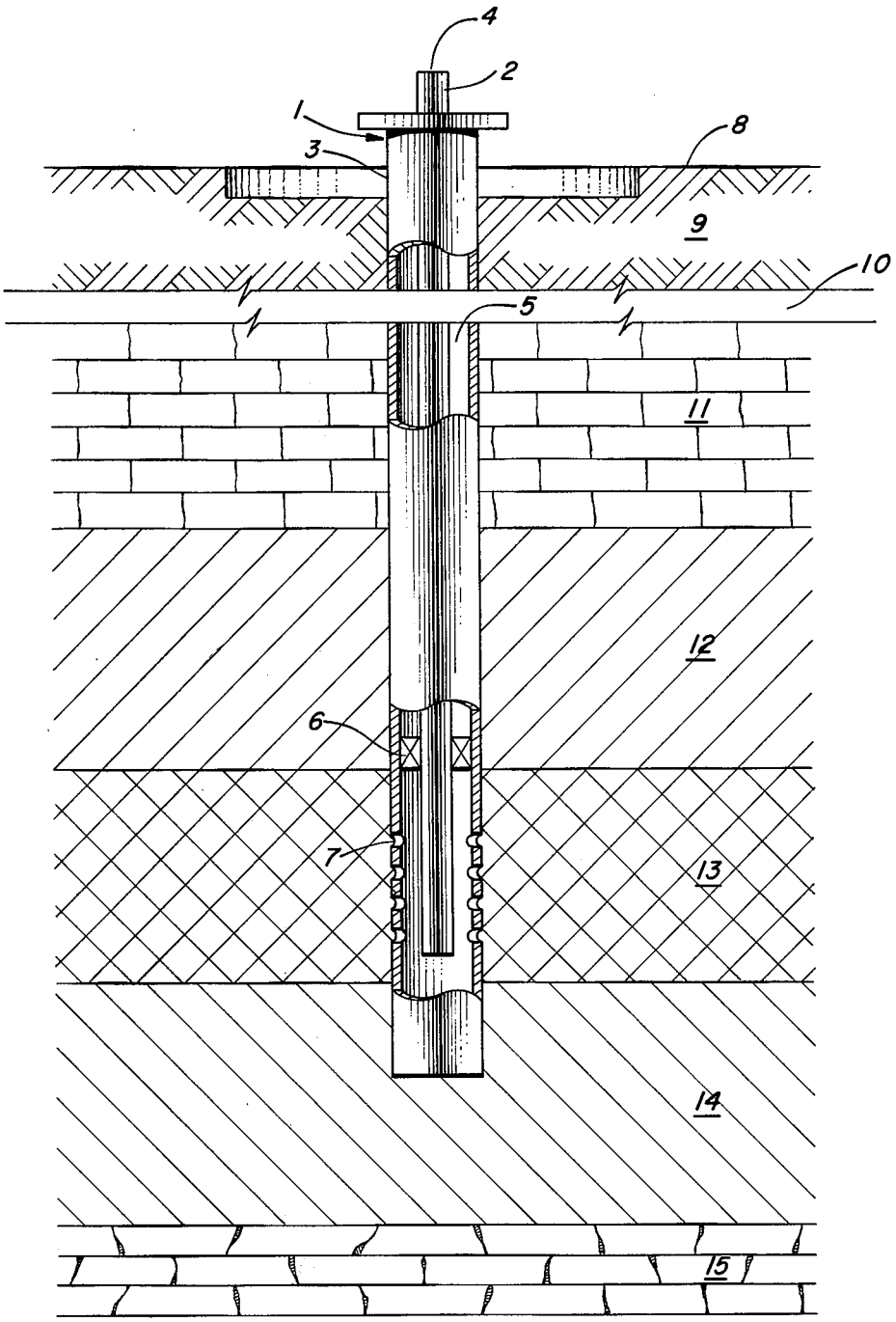

In accordance with the drawing, a cross-section of a well penetrating a subterranean formation having a geopressured section adjacent to overlying and underlying source rocks is shown.

Thus, production well 1 comprising production tubing 2 having outlet 4 and casing 3 having perforations 7 and packer 6 forming annulus 5 penetrates the surface of the earth 8 through overburden 9 to production depths (as shown by break 10) and through overlying strata 11, source rock 12, and geopressured section 13 into underlying source rock 14.

The source rocks are often shales which contain hydrocarbons which can be either gases such as methane, ethane, or the like, can be condensates, or can be heavier liquid hydrocarbons. The source rocks, which are often shale, do not have sufficient permeability for feasible production of hydrocarbons therefrom by ordinary state of the art methods.

The geopressured section 13 is usually a permeable sandstone aquifer containing an aqueous liquid which is usually a salt brine and which very often contains dissolved methane or other hydrocarbons. The pressure of the aqueous liquid in the aquifer is very high and exceeds the pressure of a column of seawater from the earth's surface to the section, and may approach the weight of the entire column of earth and rock overlying the section. The geopressured section can also be a conventional oil or gas reservoir containing hydrocarbons at high pressures.

The source rock underlying the geopressured section is similar to the source rock overlying the geopressured section.

PREFERRED EMBODIMENTS OF THE INVENTION

To illustrate one presently preferred mode of the invention, a well bore is drilled from the surface to a geopressured section 13 as shown in FIG. 1. The section contains geopressured brine having methane dissolved therein at a temperature of 300° F. and a pressure of 10,000 psig. The well is rapidly produced to remove the hot gas-containing brine and lower the bottomhole pressure to hydrostatic pressure of the brine in the well.

Upon reaching atmospheric pressure at the surface, the methane exsolves from the heated brine and is recovered. The remaining brine is disposed of.

Upon lowering of the pressure of the formerly geopressured section to that of a column of brine, the well is shut in and maintained in a shut-in condition for two years. During this time, hydrocarbons including gas and condensate migrate from the source rocks 12 and 14 into the formerly geopressured section 13, building up pressure to 4,000 psi. Thereupon, the well is put on production, and gas and condensate are produced from the formerly geopressured section 13.

According to another example illustrating another mode of the invention, a single well reservoir with no other pay zones within the well bore is produced at the rate of 5,000 cubic feet per day of natural gas and 220 barrels of condensate per day with no water for a period of 7 years. Initial bottomhole pressure is 11,804 psi at a depth of 14,250 feet. At the end of 7 years, the bottomhole pressure has declined to 4,154 psi and because it will no longer flow because of the high percentage of water being produced, the well is shut in with a wire line plug choke in the tubing.

The well is allowed to recharge for 5 years. Upon reentry after a five-year period, pressure has increased to 9,590 psi and the well flows at a rate of 5,000 cubic feet per day of gas, 244 barrels of condensate per day and no water.

Thus, production according to the process of this invention whereby the geopressured section has recharged from the source rock is demonstrated.

These examples are provided in order to more fully explain the present invention and provide information to those skilled in the art on how to carry it out. However, it is to be understood that the example is not intended to function as a limitation on the invention as described and claimed herein.

The process of this invention is limited to situations in which a geopressured section is in fluid communication with a source rock containing hydrocarbons which will migrate from the source rock into the formerly geopressured section if the pressure therein is reduced sufficiently. A number of such associated strata are found near the Gulf Coast of the United States and elsewhere. The geopressured section can either contain an aqueous liquid such as a salt brine under high pressure, or can contain aqueous liquid having hydrocarbons dissolved therein such as the geopressured aqueous zones disclosed in Report No. FE-2271-1, Natural Gas from Unconventional Geologic Sources, Board of Mineral Resources, Commission on Natural Resources, National Academy of Sciences, Washington, D.C., Contract E(49-18)-2271 (1976) reporting on a forum convened at the National Academy of Sciences, Washington, D.C., on Jan. 15, 1976.

Other suitable geopressured sections are found in association with suitable source rocks in the Gulf Coast region of the United States and elsewhere where the geopressured sections comprise conventional hyrocarbon reservoirs containing natural gas and/or oil.

I claim:

1. A process for producing hydrocarbons from a source rock in fluid communication with a geopressured section comprising:
   (a) producing fluids from the geopressured section to reduce pressure,
   (b) shutting in to allow migration of hydrocarbons from the source rock to the formerly geopressured section, and
   (c) producing the migrated hydrocarbons from the section.

2. The process of claim 1 wherein the geopressured section is a gas reservoir.

3. The process of claim 1 wherein water is produced from the geopressured section to reduce pressure in step (a).

4. The process of claim 1 wherein fluids are produced in step (a) down to a bottomhole pressure substantially not greater than a column of brine of a height equal to the depth of the well.

* * * * *